US008739791B2

(12) United States Patent
Clarke

(10) Patent No.: US 8,739,791 B2
(45) Date of Patent: Jun. 3, 2014

(54) PRESSURE REGULATOR VALVE FOR BREATHING APPARATUS

(75) Inventor: Alan Clarke, Cornwall (GB)

(73) Assignee: Clipper Data Limited, Cornwall (GB)

( * ) Notice: Subject to any disclaimer, the term of this patent is extended or adjusted under 35 U.S.C. 154(b) by 1091 days.

(21) Appl. No.: 11/931,105

(22) Filed: Oct. 31, 2007

(65) Prior Publication Data

US 2008/0099018 A1 May 1, 2008

(30) Foreign Application Priority Data

Nov. 1, 2006 (GB) ..... 0621747.5

(51) Int. Cl.
*A62B 9/02* (2006.01)

(52) U.S. Cl.
USPC ..... 128/205.24; 128/200.24; 128/204.26

(58) Field of Classification Search
USPC ..... 128/204.18–204.29, 205.11, 205.12, 128/203.16, 203.17, 200.29, 201.11; 137/15.18, 219–222; 251/28, 61–61.5, 251/331, 231
See application file for complete search history.

(56) References Cited

U.S. PATENT DOCUMENTS

| | | | | | |
|---|---|---|---|---|---|
| 3,498,312 | A * | 3/1970 | Geiszler | 137/102 |
| 3,587,622 | A * | 6/1971 | Hardison | 137/220 |
| 3,783,891 | A * | 1/1974 | Christianson | 137/491 |
| 4,041,978 | A * | 8/1977 | Leemann | 137/494 |
| 4,080,993 | A * | 3/1978 | Lind, Jr. | 137/504 |
| 4,941,468 | A * | 7/1990 | Giovanni | 128/204.26 |
| 5,176,169 | A | 1/1993 | Ferguson | |
| 5,343,858 | A * | 9/1994 | Winefordner et al. | 128/204.26 |
| 5,437,268 | A * | 8/1995 | Preece | 128/205.24 |
| 5,503,142 | A | 4/1996 | Semeia | |
| 5,660,502 | A * | 8/1997 | Ferguson | 405/186 |
| 5,803,073 | A * | 9/1998 | Toth | 128/205.24 |
| 5,950,622 | A * | 9/1999 | Pomerantz | 128/204.26 |
| 6,446,657 | B1 * | 9/2002 | Dziorny et al. | 137/219 |
| 2004/0154669 | A1 | 8/2004 | Semeia | |
| 2006/0231142 | A1 * | 10/2006 | Schwartz | 137/505.25 |

FOREIGN PATENT DOCUMENTS

| | | | |
|---|---|---|---|
| EP | 0499507 | | 8/1992 |
| EP | 1447320 | A2 | 8/2004 |
| EP | 1484242 | A2 | 12/2004 |
| GB | 949221 | * | 2/1964 |

OTHER PUBLICATIONS

UK Search Report dated Feb. 7, 2007. GB0621747.5.
European Search Report dated Feb. 22, 2008. EP 07 25 3967.

* cited by examiner

*Primary Examiner* — Justine Yu
*Assistant Examiner* — Michael Tsai
(74) *Attorney, Agent, or Firm* — Gifford, Krass, Sprinkle, Anderson & Citkowski, P.C.

(57) ABSTRACT

A re-configurable pressure regulator for breathing apparatus having a valve housing with a connector at a first and a second end. A pressurized source of breathable gas is connected to either end and a removable blanking plug is connected to the other end of the housing. A double acting valve within the housing selectively opens a first or second opening in the housing, depending on which end the source of breathable gas is connected, which opening forms the inlet and outlet from the housing.

14 Claims, 11 Drawing Sheets

PRESSURE REGULATOR VALVE FOR BREATHING APPARATUS

CROSS-REFERENCE TO RELATED APPLICATIONS

This application claims priority of Great Britain Patent Application No. 0621747.5 filed Nov. 1, 2006.

FIELD OF THE INVENTION

This invention relates to a pressure regulator for breathing apparatus, specifically but not exclusively for self-contained breathing apparatus such as can be used in environments which a user may need a supply of breathable gas. The invention is principally though not exclusively concerned with breathing apparatus such as can be used by divers in underwater environments. Other uses of breathing apparatus may include those in which the breathable atmosphere may be heavily polluted with combustion products and noxious gases, and is thus otherwise unbreathable.

BACKGROUND OF THE INVENTION

Self-contained breathing apparatus of the open circuit type generally employ regulator valves for regulating the pressure of the breathable gas contained in a pressurised cylinder or the like for presentation to the user at an appropriate pressure.

One particular type of pressure regulator is described in U.S. Pat. No. 4,041,978 which describes a pressure regulator for breathing apparatus having a source, i.e. a tank, containing a gaseous mixture of breathable gases, in which the regulator comprises a diaphragm case having an interior space, a diaphragm disposed in the diaphragm case, a valve housing, a moveable valve body disposed in the valve housing for opening and closing the regulator, and a control member for moving the valve body as a function of the position of the diaphragm with respect to the diaphragm case. The valve housing is divided by the moveable valve body into two or more chambers when the regulator is closed. A first chamber is adapted to communicate with the source of breathable gases and the second chamber communicates with the interior space of the diaphragm case. This regulator has an inlet for connecting the regulator to a tank containing a compressed mixture of breathable gases and an outlet for the gaseous mixture. A valve is provided for opening and closing the passage between the inlet and the outlet. The diaphragm operates the valve via a lever arrangement against the force of a valve spring. When the pressure at the outlet of the regulator becomes less than the ambient pressure acting on the diaphragm the diaphragm moves and this movement is transmitted via the lever to the moveable valve body in such a way that the valve opens. In this way breathable gas flows from the tank to the outlet of the regulator and to a mouthpiece for use by the user. As soon as the pressure at the outlet is increased so that it is approximately the same as the ambient pressure, for example during exhalation, the valve is closed by the valve spring.

The valve described in the above mentioned patent and other earlier published patents and applications, for example U.S. Pat. No. 5,503,142, US2004/0154669, EP1447320 and EP1484242, are inherently left or right handed in the sense that the valves are constructed with a single inlet on one side of the regulator valve body for connection to an inlet hose for delivering breathable gases to the regulator. In underwater and fireman's breathing apparatus the aforementioned regulator valve is often a second stage valve in the breathing circuit with a first stage valve being provided for reducing the pressure of the breathable gases in the tank from a high pressure to a low to intermediate pressure. However, the present invention is mainly concerned with so-called second stage regulator valves which deliver breathable gases at an appropriate pressure to the user via a suitable mouthpiece.

A problem that is often encountered with the aforementioned type of breathing apparatus regulator valve is that the valves are either left or right handed in the sense that the inlet is on one side of the valve body or the other, and while a left handed valve may be suitable for use with various different types of breathing apparatus it may not be suitable for others, and vice versa with respect to right handed valves. This can be a particular problem when divers or the like are likely to use the same pressure regulator valve with different breathing apparatus as known pressure regulator valves are not inherently re-configurable. Hitherto, it has been necessary for highly skilled technicians to dismantle and reassemble breathing apparatus regulator valves to change the configuration from say a left hand configuration to a right hand configuration, or vice versa. Re-configuration of the valve is therefore almost entirely impossible in the field and in the context of diving, particularly leisure diving, a mismatch between the actual and required configuration of the valve for use with a particular type of breathing apparatus may only become apparent at a late stage in the dive preparation, and thereby prevent the diver being able to use the available breathing apparatus resulting in cancellation of the intended dive.

There is a requirement therefore for a pressure regulator valve for breathing apparatus which can be readily reconfigured for connection of a breathing gas supply hose to either side of a valve housing.

SUMMARY OF THE INVENTION

According to an aspect of the invention there is provided a re-configurable pressure regulator for breathing apparatus, said regulator comprising a valve housing having connection means at first and second ends thereof for connection, in use, at one of said ends to a pressurised source of breathable gas and at the other of said ends to a removable blanking plug, wherein in a first configuration the said first end is closed by a removable blanking plug and in a second configuration the second end is closed by said blanking plug with the other end being connectable to said breathable source of gases.

The pressure regulator according to the above aspect of the present invention is readily re-configurable in the sense that it may be used with different types of breathing apparatus including those types where the breathing gas supply hose is arranged to be fed over the right hand shoulder of the user, or in other apparatus where it is fed over the left hand shoulder, for connection to a connector on the pressure regulator on the respective right or left hand sides thereof.

In preferred embodiments the pressure regulator is of the type which further comprises a diaphragm case and a diaphragm located therein dividing the interior of the case to provide a first chamber having an inlet/outlet for communicating breathable gases to and from a user, the first chamber accommodating at least part of said valve housing, the interior of the valve housing defining a second chamber in communication with the first chamber and accommodating a dual acting valve means which in the first configuration is operable to open and close a valve opening at the second end of said valve housing for communication with the source of breathable gases and in the second configuration is operable to open and close a valve opening at the first end of said valve housing for communication with the source, and valve control means for regulating movement of the valve means in accordance with the deflection of the diaphragm in the diaphragm case. The dual acting valve means readily enables the pressure regulator to operate, without any noticeable change in performance, in either the first or second configuration.

Preferably, the dual acting valve means comprise a pair of relatively movable valve members which are movable with respect to the valve housing, between their respective open and closed positions, in dependence on the selected configuration of the regulator, by selective engagement of a respective one of the valve members by the said valve control means. Thus, in each configuration of the regulator only a selected one of the valve members is moveable with respect to the valve housing for opening and closing a valve opening at a respective end of the valve housing. This is achieved by the selective engagement of one of the valve members by the valve control means which engagement provides for movement of the engaged valve member in accordance with the deflection of the diaphragm in the diaphragm case. The other of the valve members remains stationery within the valve housing and is effectively redundant until such time that the pressure regulator valve is reconfigured and that valve member is then engaged by the valve control means and the moveable valve member of the previous configuration is disengaged.

Preferably, the valve members are coaxially aligned within the housing. This provides for a compact and simple arrangement and readily enables the respective valve members to be engaged/disengaged by the valve control means.

In preferred embodiments the valve members are telescopically arranged with respect to each other within the housing, and more preferably the valve members comprise a pair of mutually telescopic elongate cylindrical members. This readily provides for an extremely compact arrangement since the movement of the valve members is accommodated by the other of the valve members. This enables the principal dimensions of pressure regulator valves constructed in accordance with embodiments of the present invention to be no greater than existing regulator valves comprising a single valve arrangement for one sided operation.

In preferred embodiments the pressure regulator valve further comprises biasing means for biasing the valve members towards their respective closed positions. In this respect the biased closed position of each valve member may be considered to be the neutral position of that valve member.

In preferred embodiments the biasing means comprises a spring member coaxially arranged with respect to the valve members. The spring member preferably biases the valve members apart, and preferably the spring member comprises a coil spring coaxially disposed about the valve members.

In preferred embodiments the selective engagement of a respective one of the valve members by the valve control means is effected by the connection of said blanking plug to a respective end of the valve housing and adjustment of respective valve seat inserts which determine a neutral position of the valve means in the housing such that in the first configuration a first of the valve members is positioned such that it is engaged by the valve control means for movement with respect to the valve housing and in the second configuration a second of the valve members is engaged by the valve control means for movement with respect to the housing. The neutral position of the valve means is determined by the respective portions of the valve seat inserts which act against the respective valve members at the end of the valve housing. Adjustment of the valve seats, of at least one of the seats, causes movement of the valve members with respect to the valve housing and such movement causes disengagement of the valve control means with one valve member and engagement with the other. In this way not only does the blanking plug close the connection at one end of the valve but it also allows adjustment of the relative position of the valve members within the housing so that the valve control means selectively engages an appropriate one of the valve members for operation in that a configuration of the regulator valve.

In preferred embodiments a valve seat is provided at each end of said valve housing for engagement with a valve sealing face of a respective valve member, and wherein in both the first and second configurations the blanking plug extends within a respective one of said valve seats. The neutral position of the said valve means within the housing is determined by the selected configuration of the pressure regulator. In this respect the dual acting valve means may be considered to be repositioned in one direction along the elongate axis of the valve housing when the blanking plug is applied to one end of the housing and moved in the opposite direction when the blanking plug is applied to the other end thereof by adjustment of the position of the valve seats with respect to the housing.

In preferred embodiments the valve control means comprises a lever which moves in accordance with the position of the diaphragm. Conveniently, one end of the lever is engaged by the diaphragm and the other end engages one of the valve members so that deflection of the lever by the diaphragm causes the movement at the other end of the lever to be imparted to the valve member that is engaged by the lever.

Preferably, the lever selectively engages one of the valve members, in dependence on the configuration of the said regulator, such that deflection of the lever by the diaphragm moves the respective valve member to open the respective valve opening which is normally closed when the lever is in its un-deflected position. Thus, the pressure regulator according to preferred embodiments of the invention operates in a similar manner to known pressure regulators having a single acting valve and therefore the performance of the regulator, as perceived by the user, is not substantially different to that of a known regulator that is configured for connection to a breathing hose on one side of the regulator body only.

Preferably, the diaphragm case further comprises an exhaust valve for exhausting exhaled gases from the first chamber. In the case of open circuit breathing apparatus the exhaled gases the exhaled gases would be exhausted from the breathing circuit but in the case of closed circuit re-breathing apparatus the exhale gases would be exhausted for re-circulation through the breathing circuit as is well known in the art.

According to another aspect of the invention there is provided a method of reconfiguring a pressure regulator for use with different breathing apparatus, said regulator comprising a diaphragm case and a diaphragm located therein dividing the interior of the said case to provide a first chamber having an inlet/outlet for communicating breathable gases to and from a user, the said first chamber accommodating at least part of a valve housing having connection means at first and second ends thereof for connection, in use, at one of said ends to a pressurised source of breathable gas and at the other of said ends to a removable blanking plug, wherein in a first configuration the said first end is closed by a removable blanking plug and in a second configuration the second end is closed by said blanking plug with the other end being connectable to said breathable source of gases, the interior of the valve housing defining a second chamber in communication with the said first chamber and accommodating a dual acting valve means which in said first configuration is operable to open and close a valve opening at the said second end of said valve housing for communication with said source of breathable gases and in said second configuration is operable to open and close a valve opening at the said first end of said valve housing for communication with said source, and valve control means for regulating movement of the said valve means in accordance with the deflection of the said diaphragm in the said diaphragm case; the said method comprising the steps of removing the said blanking plug from said connection means at one end of said valve housing; adjusting the position of the said dual acting valve, means with respect to the valve housing; and, connecting the plug to the connection means and the other end of the housing.

The present invention therefore also contemplates the method of reconfiguring the valve mentioned above in relation to the first aspect of the invention.

In one example the valve may be reconfigured for use with breathing apparatus where the breathable gas supply hose is arranged to be connected to the right hand side of the pressure regulator or to the left hand side.

BRIEF DESCRIPTION OF THE DRAWINGS

Various embodiments of the invention will now be more particularly described, by way of example only, with reference to the accompanying drawings, in which.

DETAILED DESCRIPTION OF THE PREFERRED EMBODIMENTS

Figure 1:
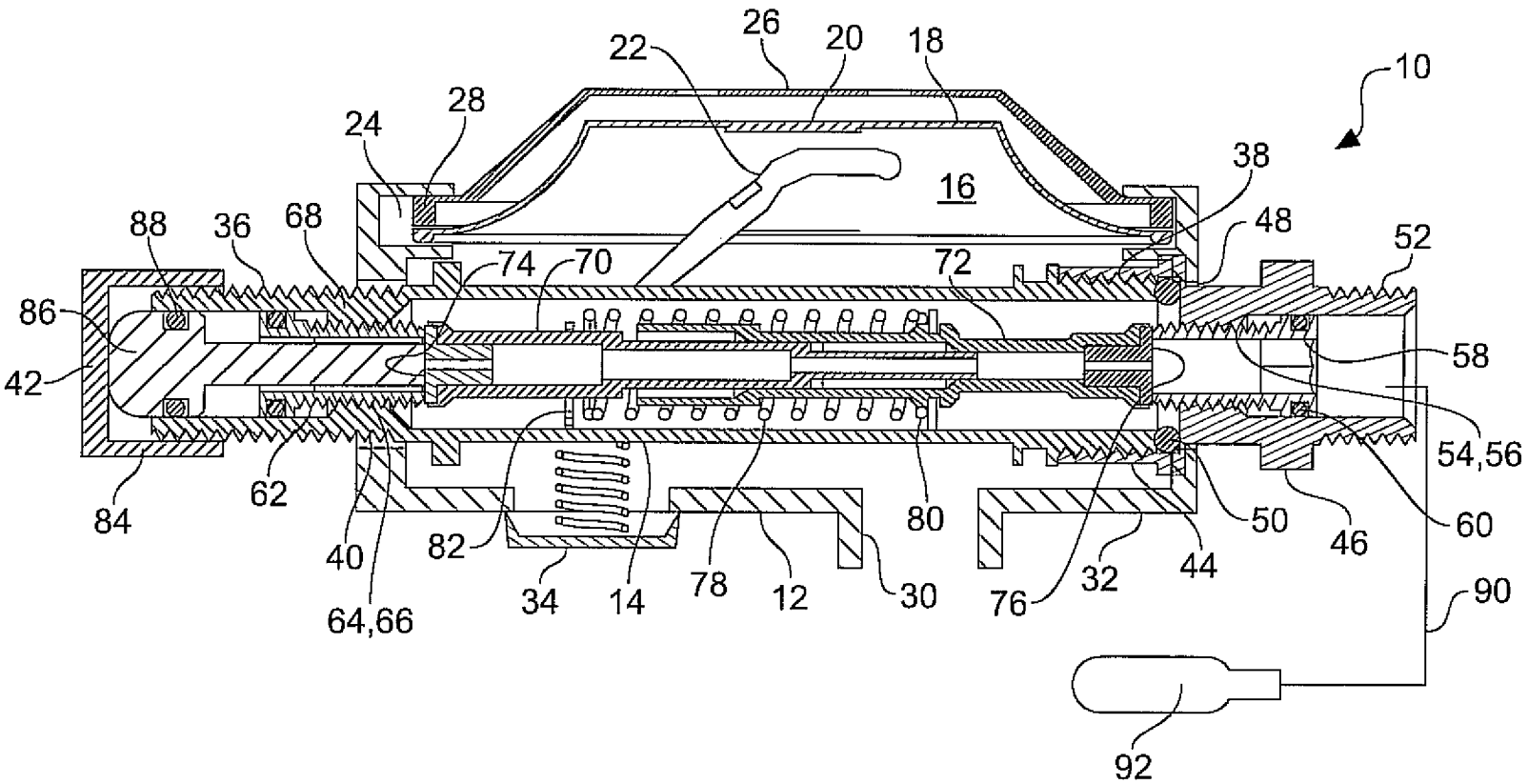
FIG. 1 is a cross-section view of a pressure regulator valve according to an embodiment of the present invention in a first configuration with the valve shown in a closed position.

Referring to the drawings, in FIG. 1 a pressure regulator valve 10 for breathing apparatus, for example underwater or fire-fighter's breathing apparatus, comprises a generally cylindrical cup-shape outer casing 12 through which a cylindrical tubular valve housing 14 extends. The axis of the valve housing 14 is essentially perpendicular to the axis of the housing 12 and therefore may be considered to extend along the diameter of the casing 12 from one side thereof to the other.

The valve housing 14 is mainly accommodated within the interior region 16 of the housing which defines a first pressure chamber of the regulator valve. The open end of the housing (towards the top of the drawing in FIG. 1) is closed by a resilient disc shape diaphragm 18 which preferably comprises an elastomeric material. The centre region of the diaphragm 20 is reinforced to provide a bearing surface for contact with a lever on 22 of a valve control means to be described in more detail below. The diaphragm 18 is secured with respect to the casing 12 around its rim where it is located in an annular groove 24 at the open end of the housing 12 which also accommodates a frusto-conical shape cover element 26. The rim of the cover element comprises an annular axially extending flange portion 28 which compresses the rim of the diaphragm 18 against the inner wall of the annular groove 24 to seal the diaphragm in the groove and hence provide a fluid tight seal between the exterior of the pressure regulator 12 and the interior 16. At the other axial end of the casing 12 there is provided a tubular opening 30 for connection to a hose or mouthpiece (not shown) through which the user can breathe. In addition to the tubular opening 30 the end wall 32 of the casing is also provided with an exhaust valve 34 which is arranged to open, in a known manner, when the pressure within the interior region 16 exceeds the outside pressure, i.e. the ambient pressure acting on the exterior of the pressure regulator.

Figure 5:
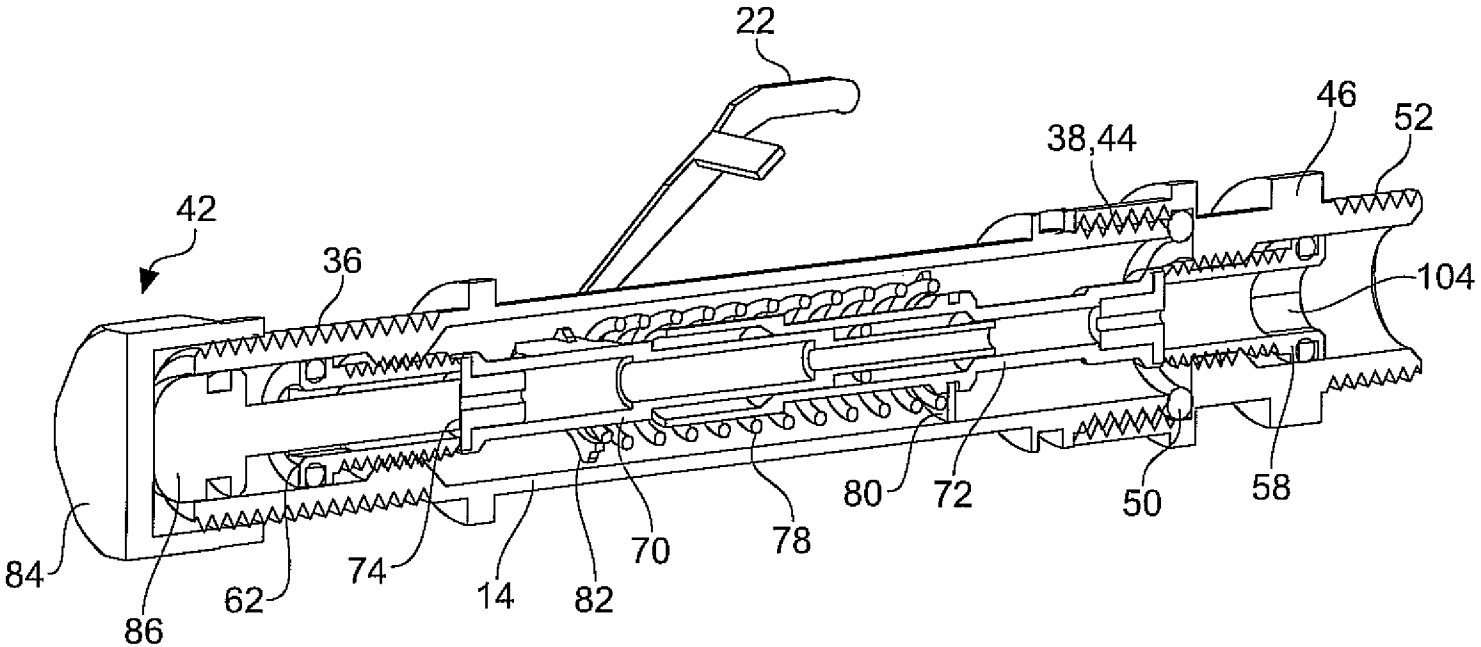
FIG. 5 is a detailed cross-section perspective view of the valve of FIG. 1 with the outer casing removed.

The valve housing 14 comprises part of a dual acting valve, the component parts of which will now be described in detail with additional reference to the drawing of FIG. 5. As can be seen in the drawings, both axial ends of the valve housing 14 are provided with external threads including an external thread 36 at one end of the cylindrical housing and an external thread 38 at the other axial end. The external thread 36 is provided on a part of the housing which extends beyond the casing 12 through an aperture 40 provided in one side of the casing. The external thread 36 provides a first connection means for connecting either a blanking plug 42 or a hose (not shown) for delivering breathable gases to the user via the regulator as will be further explained below. The external thread 38 at the other end of the housing is engaged by an internal thread 44 provided on a tubular valve housing extension part 46 which extends through the casing 12 through an aperture 48 on a diametrically opposite side of the casing to the aperture 40. Extension part 46 may be considered to be part of the valve housing 14 with the valve housing being of two-part construction for the aid of assembly and disassembly of the pressure regulator. An O-ring 50 is positioned between the end of the cylindrical housing 40 and the extension part 46 to seal the interior of the housing at the threaded joint 38, 44 where the two parts are joined. The part of the tubular extension 46 furthest from the casing 12 comprises an external thread 52 which defines a second connection means for connection to either a blanking plug 42 or a breathable gas delivery hose (not shown) as previously mentioned in relation to the description of the other end of the housing 14.

The tubular extension 46 is provided with an internal thread 54 which engages an external thread 56 provided on the outer surface of a tubular valve seat 58. The valve seat 58 is screwed into the interior of the tubular extension 46 and is provided with screw adjustment means 104 in an end face thereof facing the open end of the extension 46 so that the axial position of the valve seat 58 with respect to the valve housing 14 and extension 46 can be adjusted by use of a suitable adjustment tool entering through the extension part 46. An O-ring 60 is provided in an annular groove in the external surface of the valve seat at its end nearest the opening of the extension 46 on the external side of the exterior of the regulator valve.

A tubular valve seat 62, similar to the valve seat 58 is provided at the other end of the valve housing 14 but in this case the valve seat 62 is located substantially within the threaded portion at the end of the tubular housing 14. At this end of the valve assembly the valve seat 62 is threadably located within the valve housing by engagement of an external thread 64 with an internal thread 66 provided on a reduced diameter shoulder portion 68 on the interior of the tubular housing in the region of the outer casing 12. As can be seen in the drawings, at both ends of the valve assembly the valve seats 58 and 62 extend a small distance into the interior region of the valve housing 14 for abutment with the sealing faces of respective valve members located therein as will now be described.

The dual acting valve means further comprises a pair of generally cylindrical telescopic valve members 70 and 72. Both valve members are tubular in construction and have stepped internal and external diameters with the internal and external diameters of the valve member 70 progressively decreasing in the longitudinal direction of the valve from a sealing face end 74 thereof towards the other valve member. The internal and external diameters of the valve member 72 progressively increase in size from a sealing face end 76 thereof towards the valve member 70. The valve members 70 an 72 are mutually telescopic in the sense that the progressively decreasing stepped outer diameter of the valve member 70 is dimensioned to fit closely within the progressively increasingly stepped inner diameter of the valve member 72, with the clearance between the telescopic parts being sufficient to maintain the alignment of the dual acting valve members within the valve housing in use. The valve members are coaxially aligned within the valve housing and are further provided with a coil spring 78 disposed substantially about the overlapping region of the respective valve members for urging the valve members apart and into the closed position shown in FIG. 1, where the sealing face 76 of the valve member 72 is held in contact with the end face of the valve seat 58 and likewise the sealing face 74 of the valve member 70 is held in sealing contact with the end face of the valve seat 62.

The coil spring 78 is preloaded to provide a closing force with its axial ends restrained between first and second circlips 80 and 82 located in respective grooves on the outer surface of the respective valve members 72 and 70. The restoring force of the spring 78 is predetermined so that it provides for opening and closing of the respective valve openings without undue resistance.

In the configuration of the regulator shown in the drawings of FIGS. 1 to 5, 6 and 7, the right hand end (as shown in the drawings) of the valve is closed by the blanking plug 42 which comprises an end cap 84 and an axially extending cylindrical seal element 86 extending from the end cap into the interior of the valve seat 62 to provide a fluid tight seal between the end cap and the valve seat 62. An enlarged diameter part of the seal 86 nearest to the end cap is provided with an annular groove in its outer surface for receiving an O-ring 88 for providing a fluid tight seal between the seal 86 and the internal surface of the housing in the region of the end cap. The end gap has an internal thread for engagement with one of the external threads 36 or 52.

At the other end of the valve assembly the external thread 52 is available for connection to a breathing hose for delivery of breathable gases to the regulator as will be further described.

Figure 2:
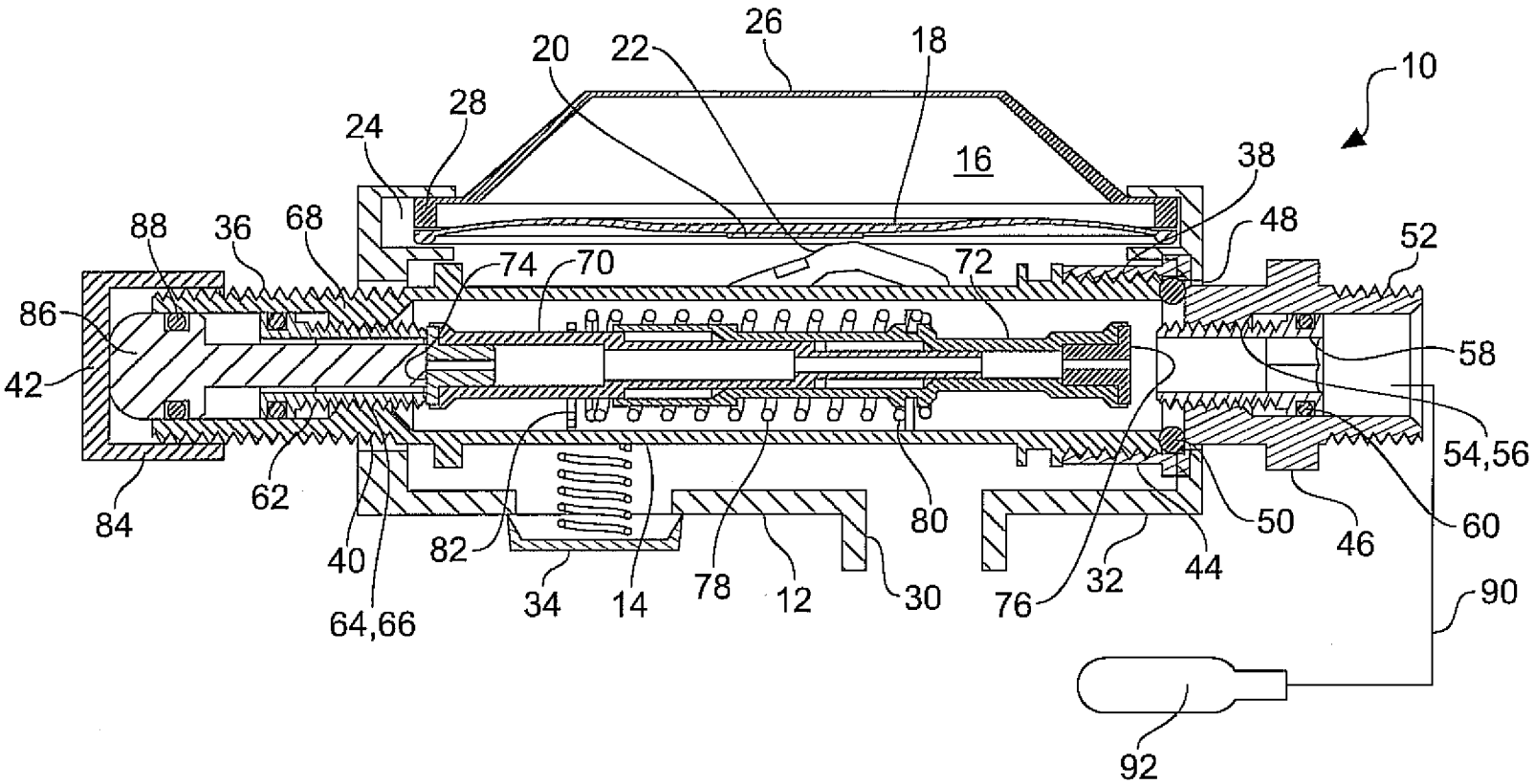
FIG. 2 is a cross-section view of the valve of FIG. 1 in the same configuration but shown with the valve in an open position.
Figure 3:
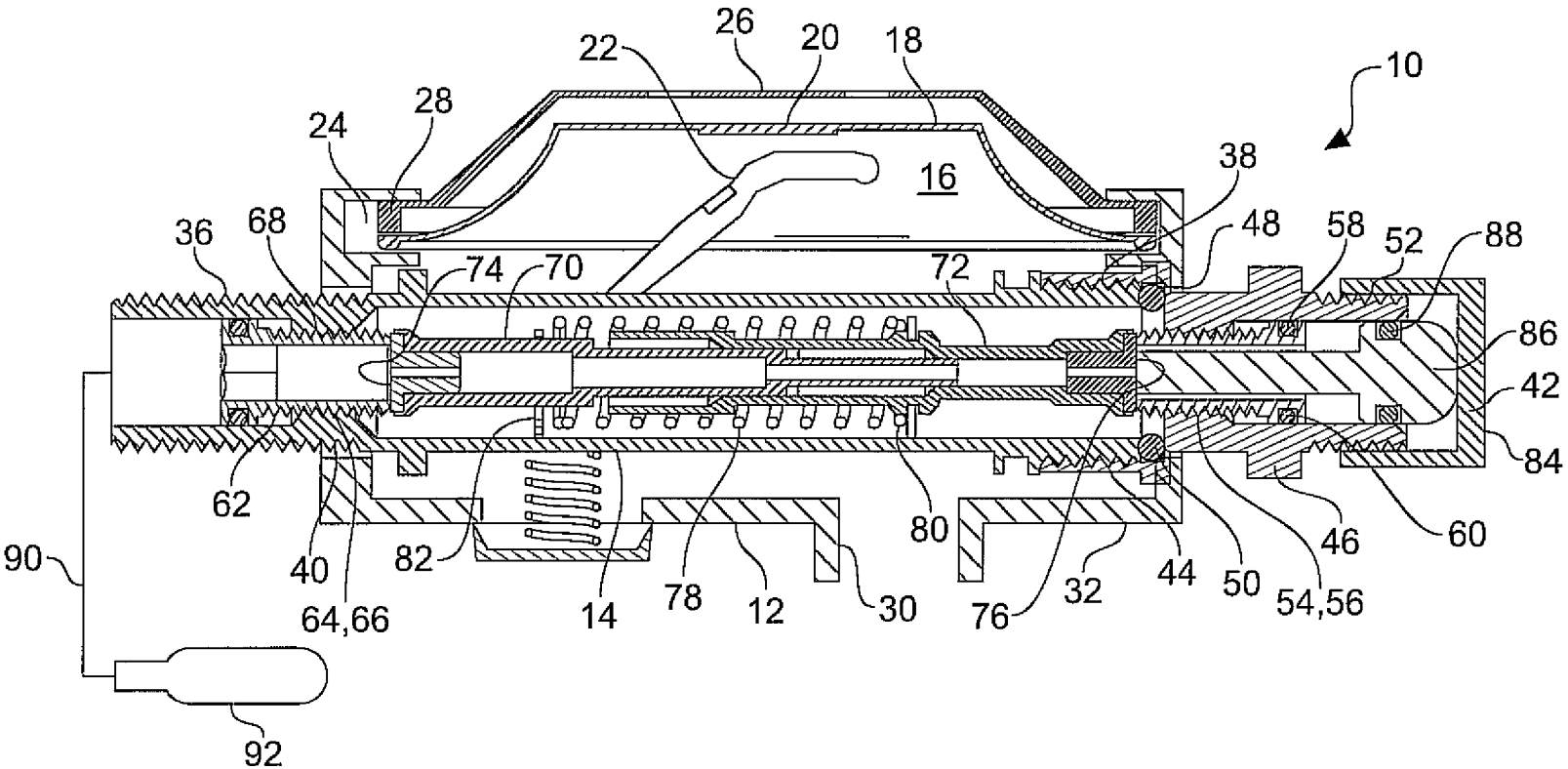
FIG. 3 is a cross-section view of the valve of FIG. 1 reconfigured in a second configuration shown with the valve closed.
Figure 4:
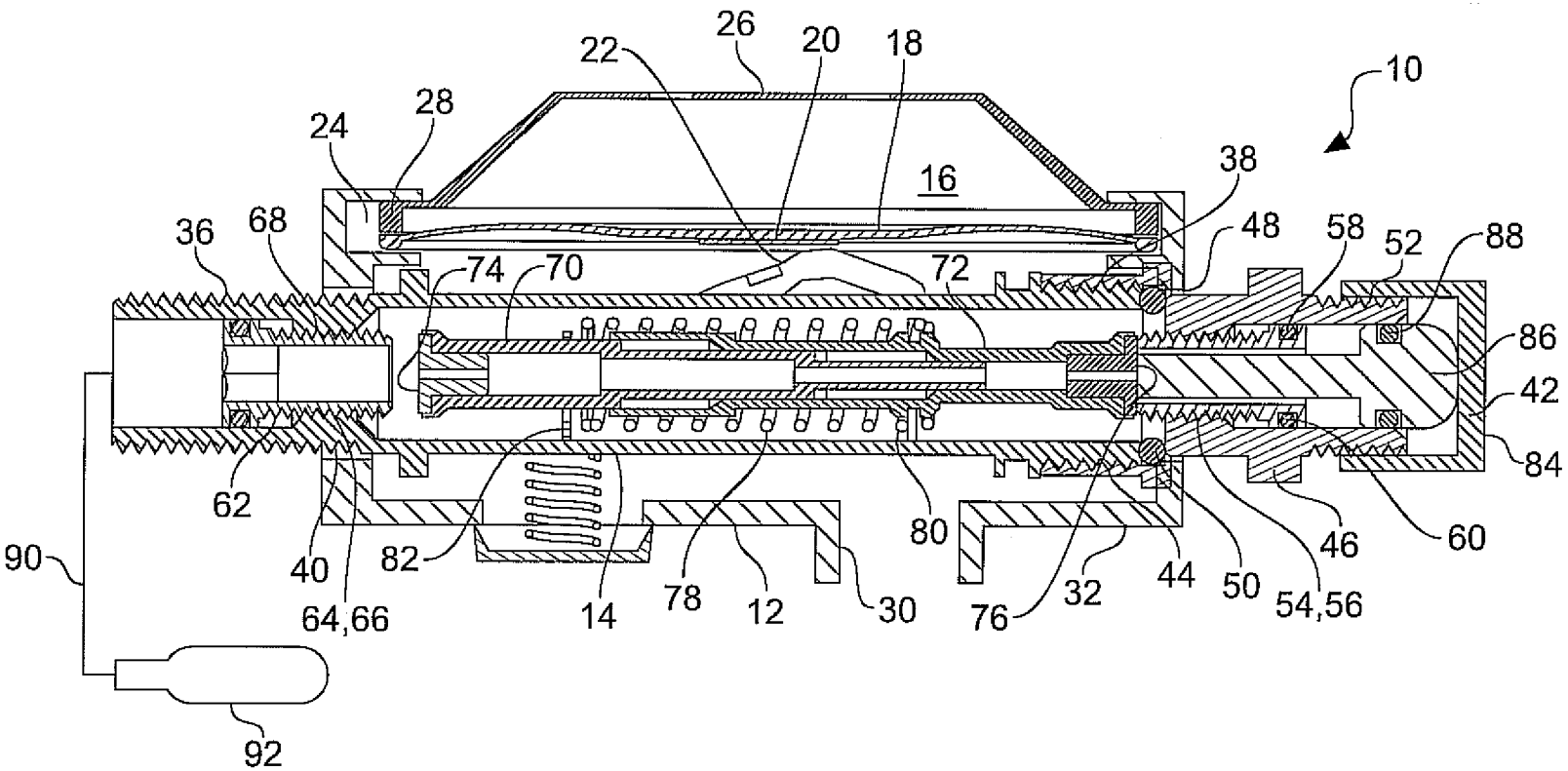
FIG. 4 is a cross-section view of the valve of FIG. 3 but with the valve in an open position.
Figure 7:
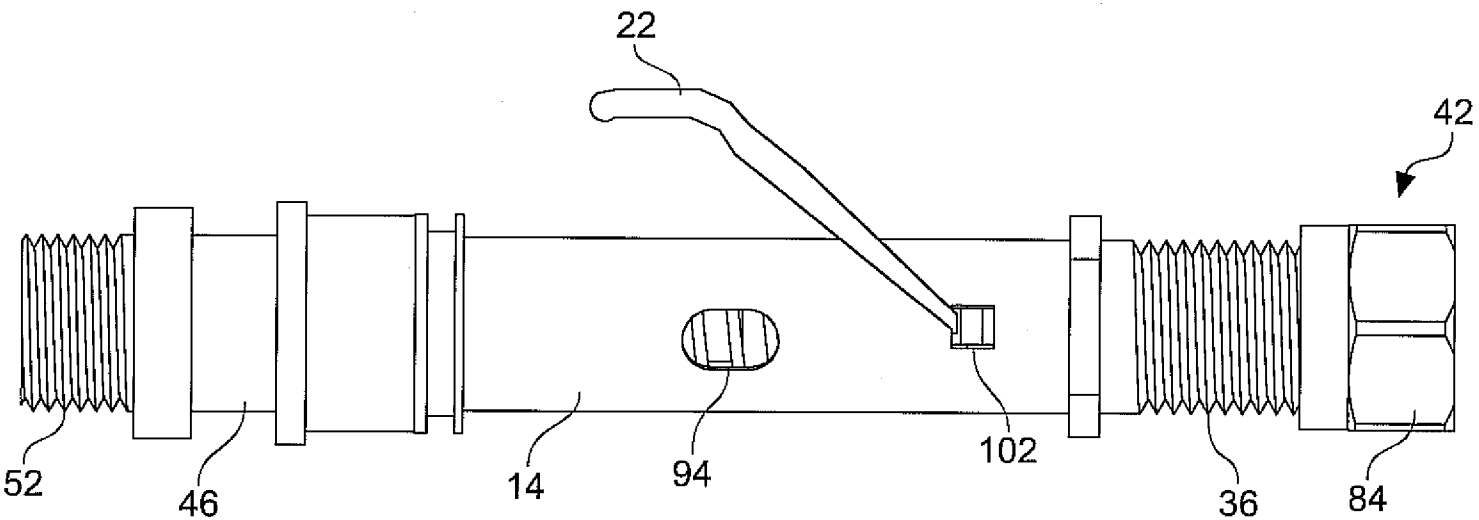
FIG. 7 is a side elevation of the valve assembly shown in FIG. 5.

Referring now to FIG. 2 which shows the pressure regulator valve in the same configuration as FIG. 1 but with the valve in an open position for receiving breathable gases. The breathable gases are delivered to the regulator valve by connection of a breathing hose, shown schematically at 90, from a source of breathable gases, for example a tank 92, to the inlet at the right hand end of the regulator (as shown in the drawings of FIGS. 1 and 2), namely by connection of the delivery hose to the external thread 52. When the person using the breathing equipment inhales, the pressure in the interior region 16 of the casing is reduced and this reduction in pressure causes a pressure differential to develop over the area of the diaphragm 18, since the other side of the diaphragm is exposed to fluid at ambient pressure. This reduction in the internal pressure causes the diaphragm to deflect and move towards the lever arm 22 of the valve control means. As the internal pressure further reduces due to the inhalation action of the user the diaphragm urges the lever towards the valve housing 14 as shown in FIG. 2 and due to engagement of the other end (not shown in the drawings of FIGS. 1 and 2) of the lever with part, or a connecting part, of the valve member 72, the valve member 72 is caused to move within the valve housing against the restoring force of the spring 78 to open the valve opening at the end of the valve where previously the valve sealing surface 76 was in contact with the valve seat. In this open position breathable gases are delivered from the source 92 through the delivery hose 90 into the interior of the pressure regulator 10 by communication of the breathable gases through the interior of the valve housing 14 into the region 16, by means of an oval shaped aperture 94 in the valve housing as shown in the drawing of FIG. 7. The valve member 72 remains open until the pressure in the interior region of the regulator reduces to the prevailing ambient pressure where the restoring force of the spring acts to close the valve due to the change in the pressure differential on the diaphragm 18. The valve member 72 then returns to the closed position of FIG. 1, and as the user exhales the exhaled gases are exhausted from the interior of the regulator through the exhaust valve 34.

Figure 6:
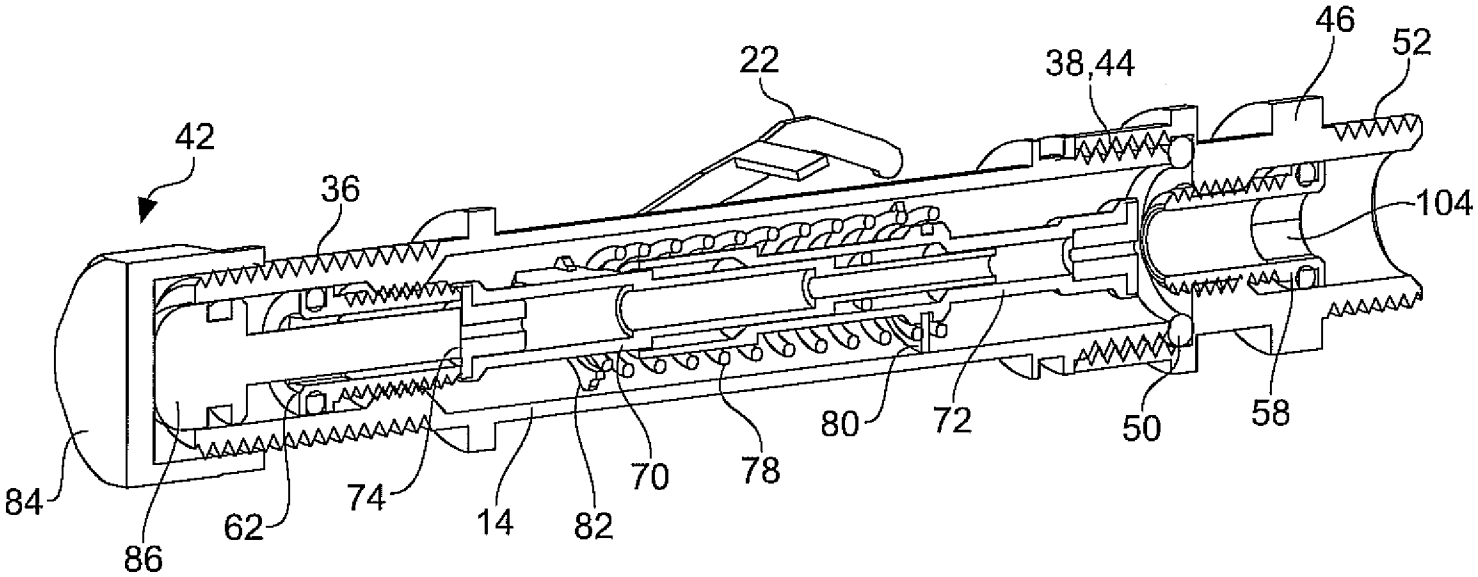
FIG. 6 shows the valve assembly of FIG. 5 with the valve in an open position as in FIG. 2.
Figure 8:
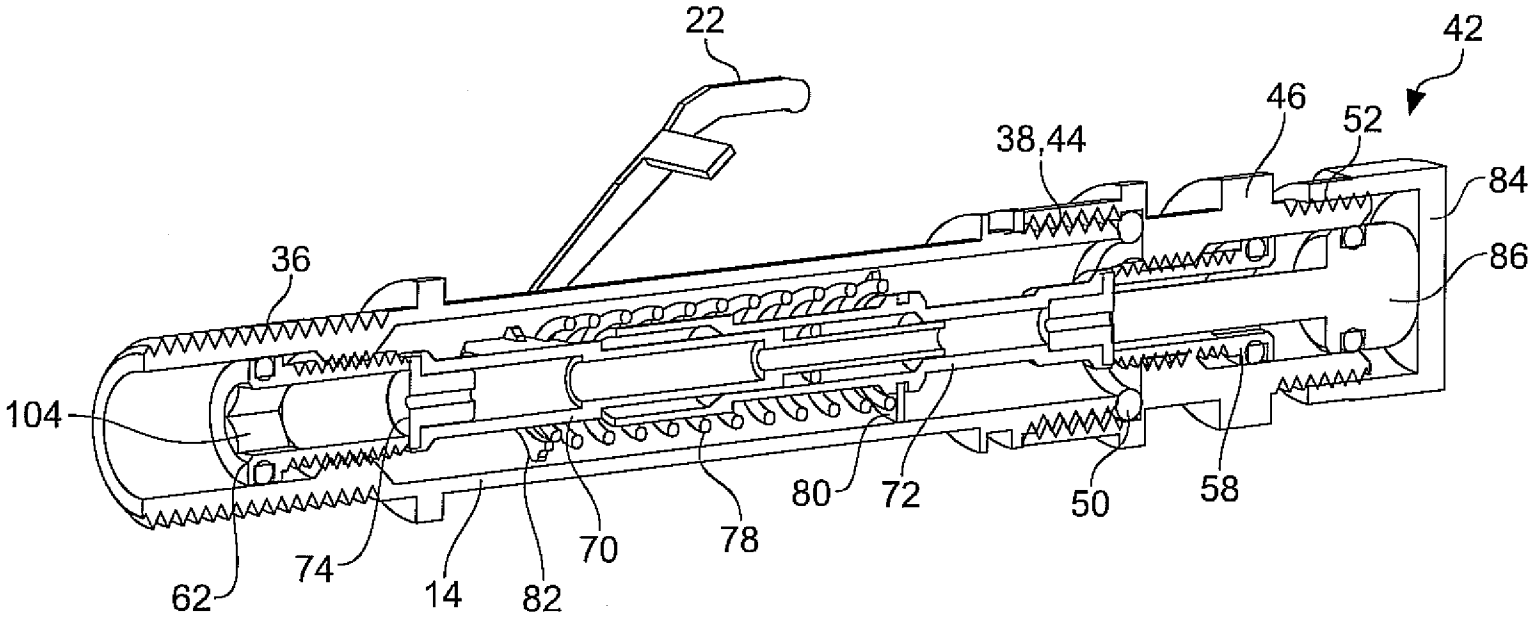
FIG. 8 is a similar view to that of FIG. 5 but with the valve assembly in the second configuration of FIG. 3 and shown in the closed position of FIG. 3.
Figure 9:
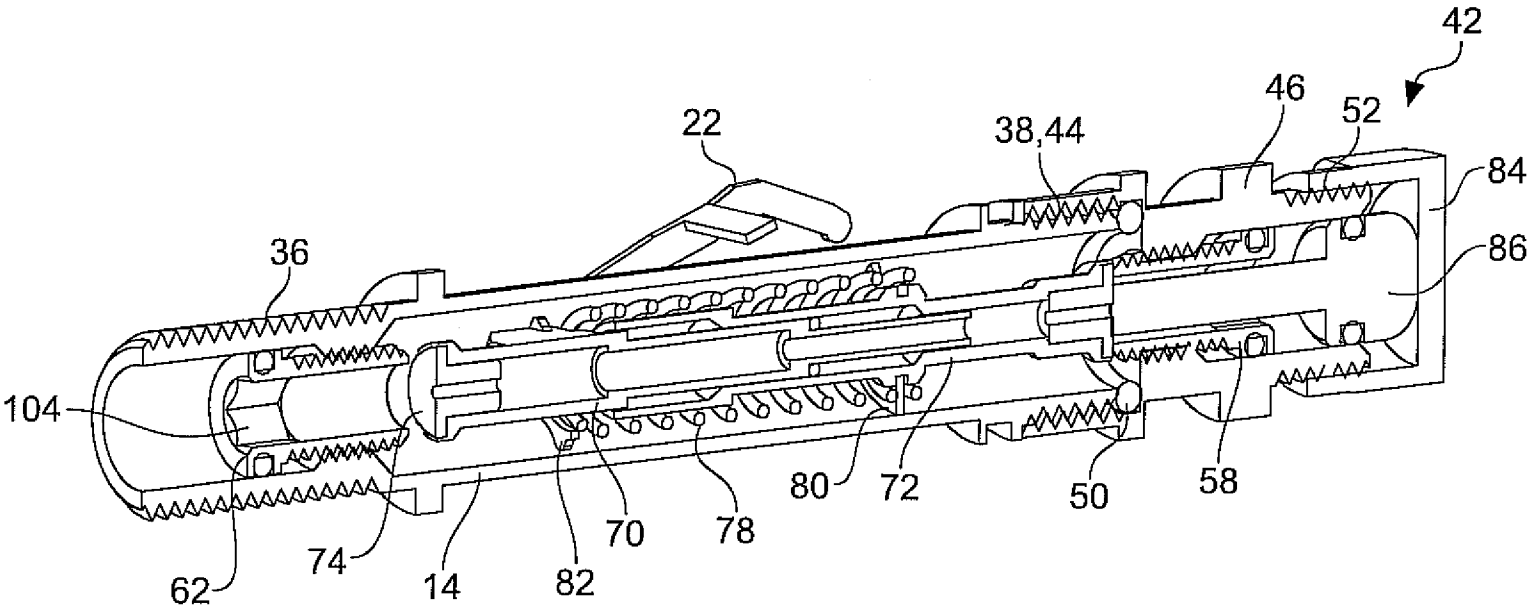
FIG. 9 shows the valve assembly of FIG. 8 in the open position of FIG. 4.
Figure 10:
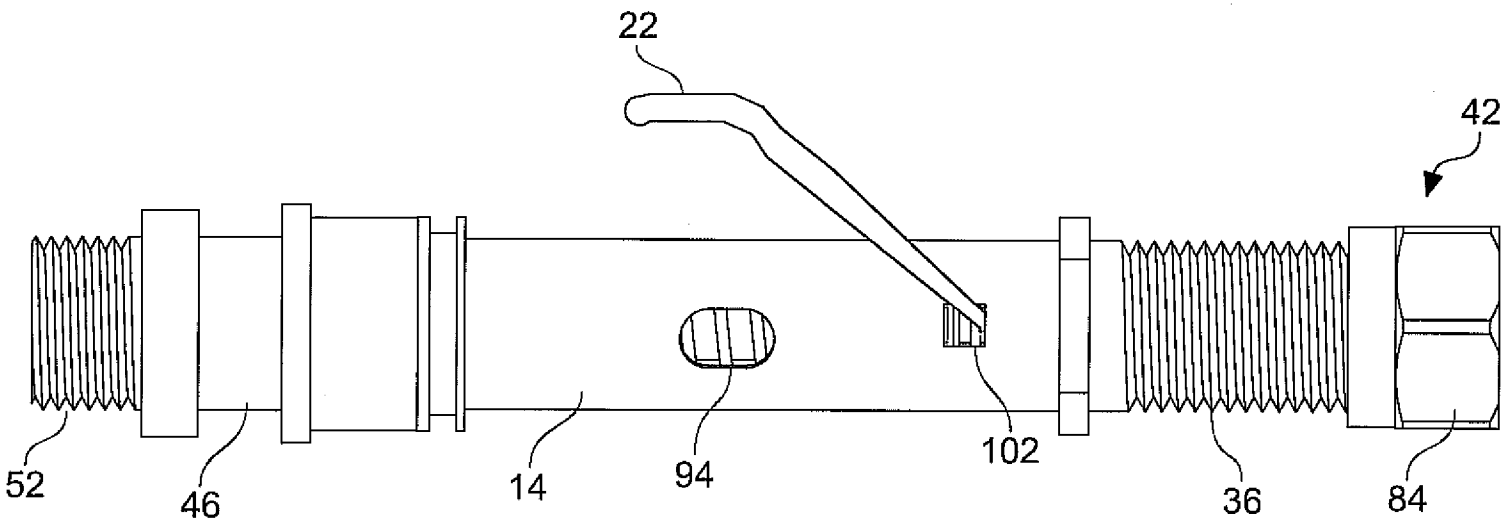
FIG. 10 is a side elevation view similar to FIG. 7 with the valve assembly in the second configuration of FIGS. 3, 4, 8 and 9.
Figure 11:
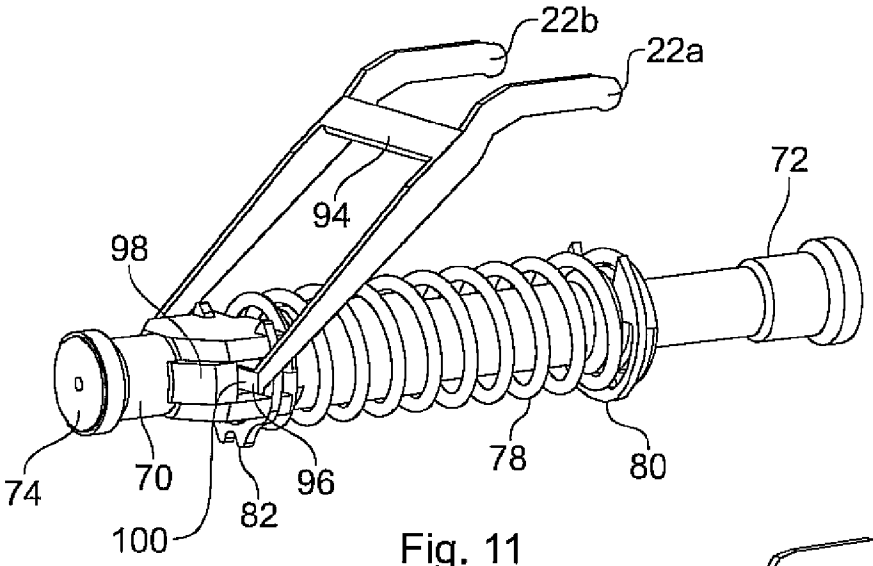
FIGS. 11 and 12 are detailed perspective views of the moving parts of the valve assembly shown in FIGS. 5 to 10 from a front and rear perspective respectively.
Figure 12:
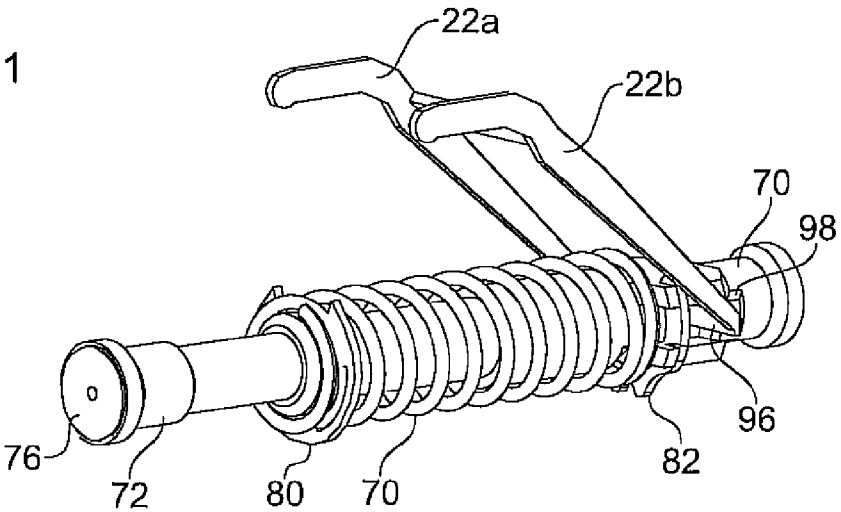

Referring now to the drawings of FIGS. 11 and 12 which show the moving parts of the valve assembly in greater detail. The lever 22 comprises a pair of parallel arms 22*a*, 22*b* which are joined by means of a lateral cross member 94 which is positioned between the lever arms at a point remote from the valve members 70, 72. The lever arms each comprise a pair of adjacent limbs which are angled with respect to each other to provide an approximate L-shape structure as best seen in the drawing of FIG. 1. As previously mentioned the shorter limbs at the end of the lever are adapted to engage a central portion of the diaphragm 20 and at the other end the levers 22*a* and 22*b* each include an inward facing tab portion 96 which extend perpendicular to the plane of the arms 22*a*, 22*b* towards the valve members 70, 72. The tabs 96 are provided on each side of the lever arm structure 22 such that they locate in a recess 100 defined between the circlip 82, which is fixed to the valve member 70 to retain the spring 78, and an end portion 98 of the valve member 72. The gap 100 that is defined between the circlip 82 and end portion 98 is sufficiently large to accommodate the respective tabs 96 and permit movement of the dual acting valve assembly comprising the valve member 70 and 72 and coil spring 78 with respect to the valve housing and the control lever 22. This arrangement enables the dual acting valve assembly to be repositioned within the valve housing 14 by adjustment of the axial position of one or more of the valve seats 58, 62 so that the inwardly projecting tabs 96 are bought into engagement with either the circlip 82 or an end face of the respective end portions 98 within the regions 100 on opposite sides of the valve assembly. In this way it is possible for the lever 22 to selectively engage either the circlip 82 for movement of the valve member 70 with respect to the valve housing or engage the end portion 98 of the valve member 72 for movement of that valve member with respect to the housing. This operation may be further understood with reference to FIGS. 7 and 10 which show the relative positions of the lever arms 22*a* and 22*b* in both configurations of the pressure regulator. For example in the configuration of FIG. 7, which corresponds to that shown in FIGS. 1, 2 and 5, the left hand side of the valve is closed by the blanking member 42 and the position of the valve seat insert 62 is adjusted such that the valve assembly is moved to the right in the drawing of FIG. 5, along the longitudinal axis of the valve housing. Corresponding adjustments may be made to the valve seat 58 at the opposite end of the housing to accommodate this adjustment such that the distance between the two sealing faces, when the valve is in its closed configuration, remains the same whether the valve is configured for right or left hand operation. As shown in FIG. 7 this causes the lever arm 22 to be moved in the same direction until further movement is prevented by engagement with the periphery of the square shape aperture 102 in the side of the valve housing 14 through which the tabs 96 pass to locate in the recessed regions 100. In the configuration of the valve shown in FIG. 7 this movement of the valve assembly causes the tabs to engage the respective adjacent surfaces of the end portions 98 of the valve element 72 so that depression of the lever 22 causes the valve member 72 to move relative to the housing, as shown in the drawings of FIG. 2 and FIG. 6, thereby opening the valve opening at the opposite end of the valve housing. Similarly, when the valve is configured for connection to a delivery hose at the other end of the valve housing the blanking plug comprising the end cap 42 and inner seal element 86 is removed from the left hand side of the valve (as shown in the drawings) and secured to the opposite end (the left hand side of the drawings) by engagement with the external thread 52. With the blanking plug removed the axial position of the respective valve seats can be adjusted by insertion of a tool through the respective open ends of the valve for engagement with adjustment tool engagement parts 104 at the respective ends of the valve seat elements furthest from the moveable valve members. Once the correct adjustment has been made the blanking plug can then be assembled onto the opposite end of the valve housing by engagement of the eternally threaded portion of the end cap with the external thread 52. The adjustment of the axial position of the respective valve seat elements, in this configuration of the valve, causes the moving parts of the valve assembly to move towards the open end of the valve, that is to say towards the left hand side of the valve in the drawings such that the respective tabs 96 engage the opposite side of the square shaped aperture 102 as shown in the drawing of FIG. 10. In this configuration further movement of the lever arm is constrained by the apertures 102 such that as the moving parts of the valve assembly are further shifted towards the left by adjustment of the valve seats the tabs engage the circlip 82, so that in this configuration of the pressure regulator when the lever 22 is depressed the lever acts on the circlip 82, which is fixed in relation to the valve member 70, which causes that valve member to move from the closed position shown in FIGS. 3 and 8 to the open position shown in FIGS. 4 and 9.

The invention claimed is:

1. A re-configurable pressure regulator for a breathing apparatus, the regulator comprising an elongated valve housing having a connection device at first and second ends thereof for connection, in use, at one of the ends to a pressurized source of breathable gas and at the other of said ends to a blanking plug, whereby to allow a user to breathe through the regulator from the pressurized source of breathable gas, wherein the regulator can be selectively adapted into one of two configurations comprising:

a first configuration, in which the first end is closed by the blanking plug and the second end is open and connectable to the pressurized source of breathable gas; and a second configuration, in which the second end is closed by the blanking plug and the first end is open and connectable to the pressurized source of breathable gas, the valve housing of said regulator accommodating an elongate valve having a first valve opening at a first end associated with the first end of the valve housing and a second valve opening at a second end associated with the second end of the valve housing, wherein, in said first configuration the elongate valve acts to open and close the second valve opening at the second end of the valve housing, and in said second configuration the elongate valve acts to open and close the first valve opening at the first end of the valve housing, wherein the regulator further comprises a diaphragm case and a diaphragm located therein dividing an interior of the case to provide a first chamber having an inlet and an outlet for communicating breathable gases to and from a user, the first chamber accommodating at least part of the valve housing, the interior of the valve housing defining a second chamber in communication with the first chamber, and valve control means for effecting movement of the elongate valve in accordance with the deflection of the diaphragm in the diaphragm case.

2. A pressure regulator as claimed in claim 1, wherein the valve comprises a pair of relatively movable valve members which are movable with respect to the valve housing, between their respective open and closed positions.

3. A pressure regulator according to claim 2, wherein the pair of relatively movable valve members which are movable with respect to the valve housing, between their respective open and closed positions by selective engagement of a respective one of the valve members by the valve control means.

4. A pressure regulator as claimed in claim 2 wherein the valve members are coaxially aligned within the housing.

5. A pressure regulator as claimed in claim 2 wherein the valve members comprise a pair of mutually telescopic elongate cylindrical members.

6. A pressure regulator as claimed in claim 4 wherein the valve members are telescopically arranged with respect to each other within the housing.

7. A pressure regulator as claimed in claim 6 further comprising means for biasing the valve members towards their respective closed positions.

8. A pressure regulator as claimed in claim 7 wherein the means for biasing comprises a spring coaxially arranged with respect to the valve members for biasing the valve members apart.

9. A pressure regulator as claimed in claim 8 wherein the spring comprises a coil spring coaxially disposed about the valve members.

10. A pressure regulator as claimed in claim 1 wherein said selective engagement of a respective one of the valve members by the valve control means is effected by adjustment of the position of the dual acting valve means with respect to the valve housing, which adjustment determines a neutral position of the dual acting valve in the housing such that in the first configuration a first of the valve members is positioned such that it is engaged by the valve control means for movement with respect to the valve housing and in the second configuration a second of the valve members is engaged by the valve control means for movement with respect to the housing.

11. A pressure regulator as claimed in claim 1 wherein an axially adjustable valve seat is provided at each end of the valve housing for engagement with a valve sealing face of a respective valve member.

12. A pressure regulator as claimed in claim 1 wherein the valve control means comprises a lever which moves in accordance with the position of the diaphragm.

13. A pressure regulator as claimed in claim 12 wherein the lever selectively engages one of the valve members such that deflection of the lever by the diaphragm moves the respective valve member to open the respective valve opening which is normally closed when the lever is in its un-deflected position.

14. A pressure regulator as claimed in claim 1 wherein the diaphragm case further comprises an exhaust valve for exhausting exhaled gases from the first chamber.

* * * * *